US008622432B2

(12) United States Patent
Bloomberg

(10) Patent No.: US 8,622,432 B2
(45) Date of Patent: Jan. 7, 2014

(54) BINDING ELEMENT AND ASSOCIATED METHOD FOR BINDING

(71) Applicant: Martin H. Bloomberg, Seekonk, MA (US)

(72) Inventor: Martin H. Bloomberg, Seekonk, MA (US)

( * ) Notice: Subject to any disclaimer, the term of this patent is extended or adjusted under 35 U.S.C. 154(b) by 0 days.

(21) Appl. No.: 13/743,609

(22) Filed: Jan. 17, 2013

(65) Prior Publication Data

US 2013/0189055 A1 Jul. 25, 2013

Related U.S. Application Data

(60) Provisional application No. 61/590,513, filed on Jan. 25, 2012, provisional application No. 61/599,546, filed on Feb. 16, 2012.

(51) Int. Cl.

| | |
|---|---|
| ***B42D 1/00*** | (2006.01) |
| ***B42F 3/02*** | (2006.01) |
| ***B42F 13/02*** | (2006.01) |
| ***A44B 1/04*** | (2006.01) |
| ***A44B 11/25*** | (2006.01) |
| ***A44B 17/00*** | (2006.01) |
| ***B42F 1/02*** | (2006.01) |

(52) U.S. Cl.
USPC ..... 281/21.1; 281/27.3; 24/67.3; 24/67.9; 24/67 P; 412/900; 402/19; 402/20

(58) Field of Classification Search
USPC ..... 281/27.3, 21.1; 24/67.3, 67.9, 67 P; 412/900
See application file for complete search history.

(56) References Cited

U.S. PATENT DOCUMENTS

| | | | | |
|---|---|---|---|---|
| 205,095 | A * | 6/1878 | Huntington | 281/27.3 |
| 307,817 | A * | 11/1884 | Tapley | 281/27.3 |
| 386,513 | A * | 7/1888 | Weeks | 24/67.9 |
| 1,256,426 | A * | 2/1918 | Baltzley | 24/456 |
| 3,131,445 | A | 5/1964 | Lorber | |
| 4,108,351 | A | 8/1978 | Hough | |
| 4,141,100 | A | 2/1979 | Domroe et al. | |
| 4,351,546 | A | 9/1982 | Cognata | |
| 4,575,123 | A | 3/1986 | Giblin et al. | |
| 4,934,738 | A | 6/1990 | Colonna | |
| 5,052,873 | A | 10/1991 | Parker et al. | |
| 5,356,063 | A | 10/1994 | Perez | |
| 5,425,554 | A | 6/1995 | Lamanna | |
| 5,445,467 | A | 8/1995 | Peleman | |
| D381,041 | S | 7/1997 | Lammers et al. | |

(Continued)

FOREIGN PATENT DOCUMENTS

| | | |
|---|---|---|
| EP | 0404556 | 12/1990 |
| WO | 2011/004245 | 1/2011 |

*Primary Examiner* — Kyle Grabowski
(74) *Attorney, Agent, or Firm* — Salter & Michaelson

(57) ABSTRACT

A binding structure for binding a bundle of sheets and that includes a base and a pair of opposed position legs that are integrally formed with and extend from respective sides of the base. The pair of legs and base together defines a retention area in which the bundle of sheets is held. The pair of legs is constructed and arranged with a resilient bias toward each other, but separable to enable the bundle of sheets to be held therebetween under a biasing force. The legs each have at least one inwardly directed rib arranged for contact with opposed sides of the bundle of sheets, and a thermal adhesive layer is disposed on the base and upon which the bundle of sheets rests, to be later formed in a thermal binding machine.

15 Claims, 6 Drawing Sheets

(56) References Cited

U.S. PATENT DOCUMENTS

| | | | | |
|---|---|---|---|---|
| 5,682,650 | A * | 11/1997 | Noguchi et al. | 24/67.3 |
| 5,733,087 | A * | 3/1998 | Gwyn | 412/900 |
| 5,873,601 | A | 2/1999 | Peleman | |
| 5,947,524 | A | 9/1999 | Podosek | |
| 6,009,924 | A | 1/2000 | Peleman | |
| 6,036,229 | A | 3/2000 | Peleman | |
| D447,171 | S | 8/2001 | Wolff et al. | |
| 6,371,520 | B1 | 4/2002 | Wolff et al. | |
| 6,422,797 | B2 * | 7/2002 | Pas | 24/67.3 |
| 6,652,210 | B1 * | 11/2003 | Yeaple | 412/900 |
| 6,746,050 | B2 | 6/2004 | Peleman | |
| 6,861,140 | B2 | 3/2005 | Peleman | |
| 7,097,378 | B2 | 8/2006 | Peleman | |
| 7,438,321 | B2 | 10/2008 | Peleman | |
| 7,841,626 | B2 * | 11/2010 | Peleman | 281/27.3 |
| 7,937,813 | B2 | 5/2011 | Peck et al. | |
| D655,752 | S | 3/2012 | King et al. | |
| 2001/0003571 | A1 | 6/2001 | Pas | |
| 2003/0061688 | A1 | 4/2003 | Rodriguez et al. | |
| 2008/0213032 | A1 * | 9/2008 | Hoarau et al. | 402/20 |
| 2011/0110704 | A1 | 5/2011 | Peleman | |
| 2012/0248753 | A1 | 10/2012 | Mindler | |

* cited by examiner

BINDING ELEMENT AND ASSOCIATED METHOD FOR BINDING

RELATED APPLICATIONS

Priority for this application is hereby claimed under 35 U.S.C. §119(e) to commonly owned and co-pending U.S. Provisional Patent Application Nos. 61/590,513 which was filed on Jan. 25, 2012 and 61/599,546 which was filed on Feb. 16, 2012; each of which were filed in the name of Martin Bloomberg, and each of which is incorporated by reference herein in its entirety.

FIELD OF THE INVENTION

The present invention relates in general to an improved binding element. The present invention also relates to a method for binding documents using an improved binding element.

BACKGROUND OF THE INVENTION

There presently exists thermal binding products that include wraparound covers with adhesive in the spine. These covers may be made of a one or two piece wrap around paper, or paper/plastic combination. They have also been made by utilizing a stiff channel which can be metal in combination with paper or plastic covers that can be of a permanent or temporary nature. These products may be comprised of U-shaped channels of metal with an adhesive placed either directly onto the metal or placed on an absorbent material that has been attached to the metal. The problem of guiding pages that are inserted into such folders to avoid sheets being caught by a protruding lip has been addressed in the prior art with the use of end sheet liners, or the shaped application of an internal adhesive.

Desktop thermal binding machines and thermal binding covers have been developed and gained some acceptance in document binding over the past 30 years or so. The basic product is an empty soft cover or hard cover book that has a hot melt adhesive or resin in the spine. One picks a cover with the appropriate spine width and places the sheets to be bound inside. The cover is then placed spine down against a heated plate. After a minute or so the adhesive liquefies to a point where it can slightly wick into the sheets. The cover is removed, and placed in a rack to cool down, after which time one has a bound book. This bond is permanent and cannot be undone without tearing a page unless the cover is reinserted into a binding machine, reheated and carefully edited. This makes the report more suitable for legal documents and similar presentations where alterations would not be welcome.

The various thermal binding machines that form the bulk of the market operate in a temperature range from 250 F to over 375 F. The machines are basically hotplates with vertical holders and timers. Because high temperatures are involved, it is necessary to have at least one or both covers attached to the U-shaped spine or a complete wrap-around cover in order to place and remove the booklet from the binding machine. A disadvantage of this arrangement is that covers that already have hot melt adhesive inside cannot be run through printers for desktop customization and any other customization, like foil-stamping, requires additional handling. One solution to this problem has been to use a permanent glue to pre-attach temporary front and back covers to a U-shaped metal channel. A customized front and back cover can then be inserted and the temporary covers can be torn off after the binding process has been completed. Such covers require a wide variety of predetermined spine widths to accommodate the varying range of sheets to be bound. Also, this process is quite time consuming.

Accordingly, another object of the present invention is to provide a product and system that eliminate the need for temporary front and back covers.

Still another object of the present invention is to provide a product and system having permanent front and back covers can be readily printed or customized in standard formats. The following represent an additional list of objects of the present invention:

(a) a new and simpler element for producing an effective binding;

(b) a binding that is in the form of an extrusion or co-extrusion used to create the binding element;

(c) an improved binding element that can be readily attached to sheets of paper and front and back covers for easy insertion into and removal from a thermal binding machine;

(d) an improved binding element and an associated method of using the binding element and in which there is eliminated the requirement for handles or attached cover sheets;

(e) a means to allow the binding elements to have a greater range of content or sheet number thus requiring fewer spines sizes to be inventoried;

(f) a means for manufacturing of the binding element itself with extrusion or co-extrusion techniques.

SUMMARY OF THE INVENTION

To accomplish the foregoing and other objects, features and advantages of the present invention there is provided a binding structure for binding a bundle of sheets and comprised of an element that includes a base and a pair of opposed position legs that are integrally formed with and extend from respective sides of the base. The pair of legs and base together defines a retention area in which the bundle of sheets is held. The pair of legs is constructed and arranged with a resilient bias toward each other, but separable to enable the bundle of sheets to be held therebetween under a biasing force. The legs each have at least one inwardly directed rib arranged for contact with opposed sides of the bundle of sheets, and a thermal adhesive layer is disposed on the base and upon which the bundle of sheets rests, to be later formed in a thermal binding machine.

In accordance with other aspects of the present invention there is provided a series of spacedly disposed inwardly directed ribs on each of the pair of legs; each rib may be pointed; each leg may include a turned end and the at least one rib extends from a respective turned end; including a series of spacedly disposed inwardly directed ribs on each of the turned ends of the respective pair of legs; the turned ends are may be tapered; optionally including a metal insert in the base; wherein the metal insert extends into each leg; including a thermal adhesive on the base and a contact adhesive disposed over the thermal adhesive; including a separate channel carrying a thermal adhesive and a slot at the base for receiving the channel; including a staple extending through the bundle of sheets; including a series of spacedly disposed inwardly directed ribs on each of the pair of legs, and the staple is engageable with at least one of the ribs.

In accordance with another embodiment of the present invention there is provided a binding structure for binding a bundle of sheets having opposed covers and comprised of an element that includes a base, and a pair of opposed position leg members that are integrally formed with and extend from respective sides of the base. The pair of leg members and base together defines a retention area in which the bundle of sheets is held. The pair of leg members is constructed and arranged with each formed by a set of inner and outer legs that are disposed substantially in parallel defining a channel therebetween for receiving respective opposed covers. The inner legs each have at least one inwardly directed rib arranged for contact with respective sides of the bundle of sheets.

In accordance with other aspects of the present invention the pair of legs of a leg member have inner facing surfaces that define the channel with at least one of the inner facing surfaces having a set of engagement teeth for holding a cover; wherein both facing surfaces of a set of legs have engagement teeth; including a thermal adhesive layer disposed on the base and upon which the bundle of sheets rests; and wherein the adhesive layer is disposed between the leg members and also within each channel.

In accordance with another embodiment of the present invention there is provided a method of processing a binding element for retaining sheets, comprising the steps of: providing a binding element that includes a base, a pair of opposed position legs that are integrally formed with and extend from respective sides of the base, said pair of legs and base together defining a retention area in which the bundle of sheets is held, said pair of legs constructed and arranged with a resilient bias toward each other, but separable to enable the bundle of sheets to be held therebetween under a biasing force; providing a thermal adhesive layer disposed on the base and upon which the bundle of sheets rests; constructing the binding element of an engineered plastic that can withstand temperatures in a range of at least 400 F to 600 F without deforming or weakening the binding element; and transferring the binding element to a thermal binding machine to subject the binding element to temperatures in a range of 250 F to 375 F in order to adhere the binding element and sheets. The method may also include providing the binding element and adhesive as a co-extrusion.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. In accordance with the present invention, although the drawings are shown to scale, the proportions and relative scale can be altered depending upon the particular application and thus the invention should not be limited to any particular construction or scale of construction. The foregoing and other objects and advantages of the embodiments described herein will become apparent with reference to the following detailed description when taken in conjunction with the accompanying drawings in which.

DETAILED DESCRIPTION

Figure 1:
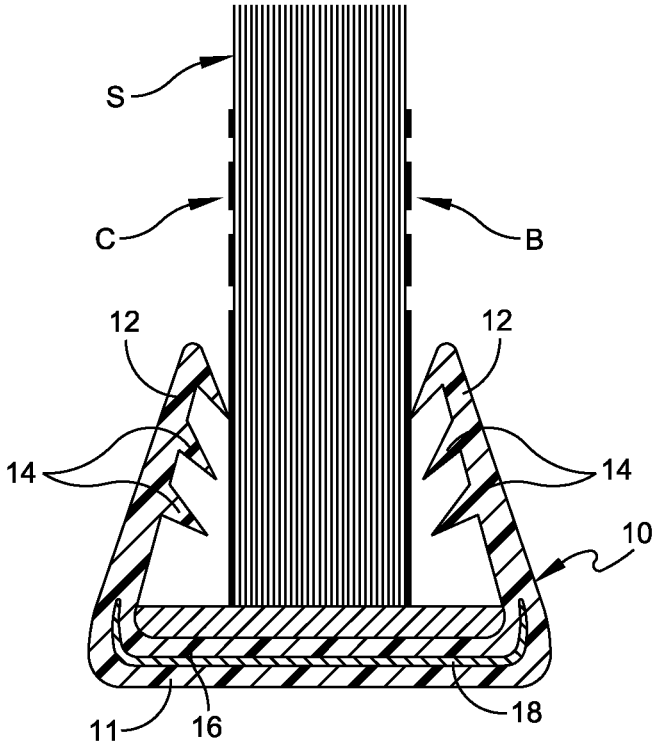
FIG. 1 is a cross-sectional view of a first embodiment of the present invention.

Reference is now made to the drawings and a number of different cross-sectional views that depict different embodiments of the present invention. In each of these embodiments there is provided a plastic extrusion or a co-extrusion that is used to provide a binding element. Although a preferred plastic is used in accordance with the present invention other materials can be employed for the basic binding element such as a metal material. Hereinafter there is a further discussion of preferred plastics. Thus, in FIG. 1, there is provided an extruded element 10 having a base 11 and integrally formed opposed legs 12. As illustrated in FIG. 1, each of the legs 12 preferably has inwardly directed ribs 14, and at least one of such ribs. The extruded plastic element 10 is constructed so as to provide a bias of the legs 12 against the respective front and back covers of the sheets being bound. This is illustrated in FIG. 1 by the front cover C, the back cover B and the sheets S. Similar designations are used with respect to the other embodiments described in additional cross-sectional views.

In the embodiment of FIG. 1, the legs 12 hold the contents firmly while at the same time enabling a great range of content, thus requiring fewer spine sizes to be inventoried. In FIG. 1 the normal rest position of the legs 12 would be a position in which they are closer together than that illustrated in FIG. 1 but can be spread in order to accommodate the sheets and front and back covers. In this regard one of the important aspects of the binding element disclosed herein is the angular direction of the legs 12 toward each other. This angular displacement, along with the preferred multiple ribs 14, provides for a firm grasp of the sheets and covers regardless of the thickness of the overall sheet and cover thickness. In the view of FIG. 1 the very top of each leg 12, in the rest position thereof, may be spaced apart half the distance illustrated in FIG. 1. That spacing provides a firm bias of both legs in the direction of the sheets S. FIG. 1 also illustrates the thermal adhesive 16 that is disposed on the top of the base 11. The adhesive layer may be provided as a unit or co-extrusion with the binding element itself There may also be provided an optional metal insert 18 that provides additional strength. In FIG. 1 the metal insert 18 is shown basically only extending along the base 11 of the binding element. However, in other embodiments of the present invention (see FIG. 4) the insert may also extend upwardly at its ends into each leg 12.

Figure 2:
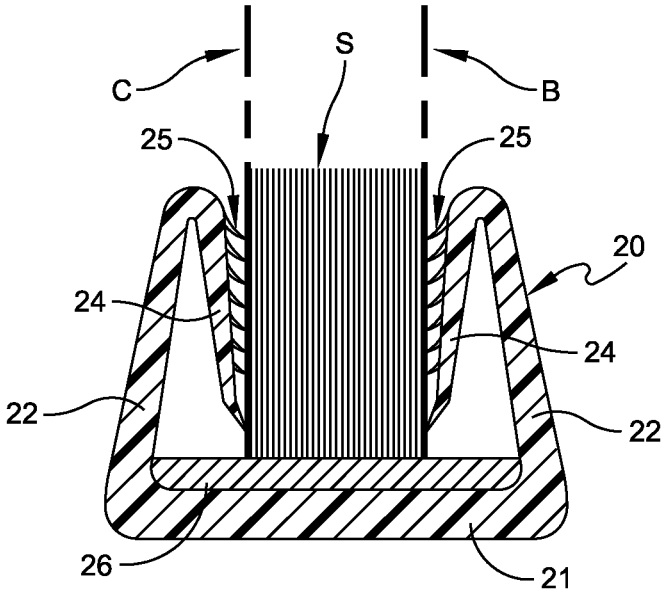
FIG. 2 is a cross-sectional view of a second embodiment of the present invention.

Reference is now made to a second embodiment of the present invention illustrated in FIG. 2. This also includes an extruded plastic element 20 having a base 21 and opposed legs 22.

In this embodiment, each of the legs 22 has a turned end 24 with extending retention teeth 25 on the surface that faces the sheets S. FIG. 2 also illustrates the thermal adhesive 26 that may be extruded with the base 21 or added by hot melt or separate glue strip or by an adhesive insert. As in the embodiment of FIG. 1, in the embodiment of FIG. 2, the legs 22 are biased inwardly and are used for holding the contents firmly while at the same time allowing the element to accommodate a wide range of thickness of the sheets and covers. In FIG. 2 the leg 22 would not be as angularly disposed as in the embodiment of FIG. 1, as the embodiment shown in FIG. 2 also has the turned end. Also the very free end of the leg 24 may be pointed as illustrated in FIG. 2 to provide further contact force with the sheets and covers. In the view of FIG.

2 the very top of each leg, as in FIG. 1, in the rest position thereof, may be spaced apart half the distance illustrated in FIG. 2.

Figure 3:
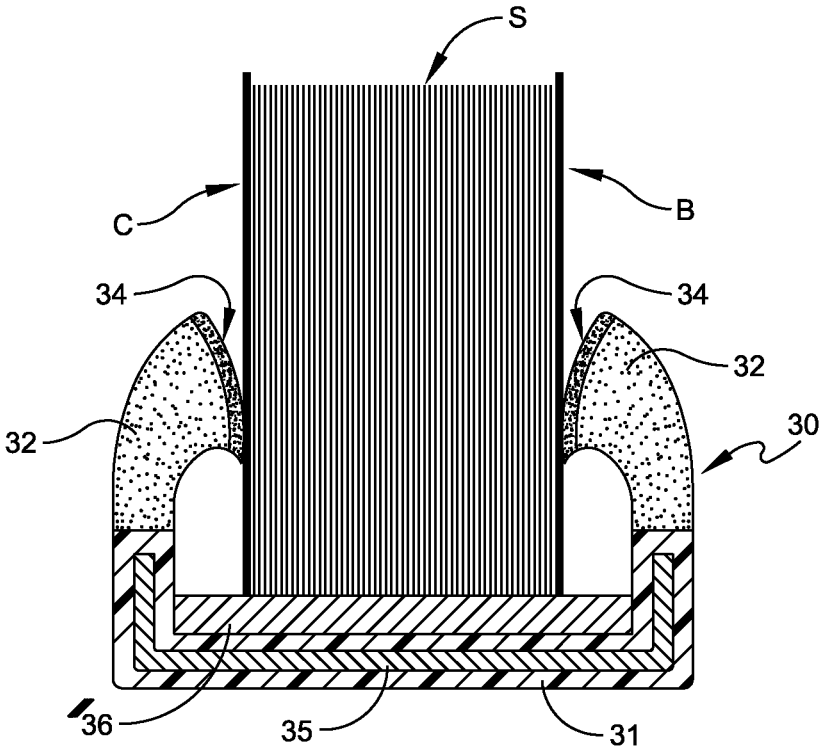
FIG. 3 is a cross-sectional view of a third embodiment of the present invention.

Reference is now made to FIG. 3 for a third embodiment of the present invention in the form of a coextruded element 30. This element may be a co-extrusion of a hard extruded plastic including the base 31 and a more spongy plastic material forming the legs 32. Facing surfaces of the legs 32 are preferably provided with a gripping surface at 34. FIG. 3 also depicts the thermal adhesive 36 as well as the optional metal reinforcement insert 35.

Figure 4:
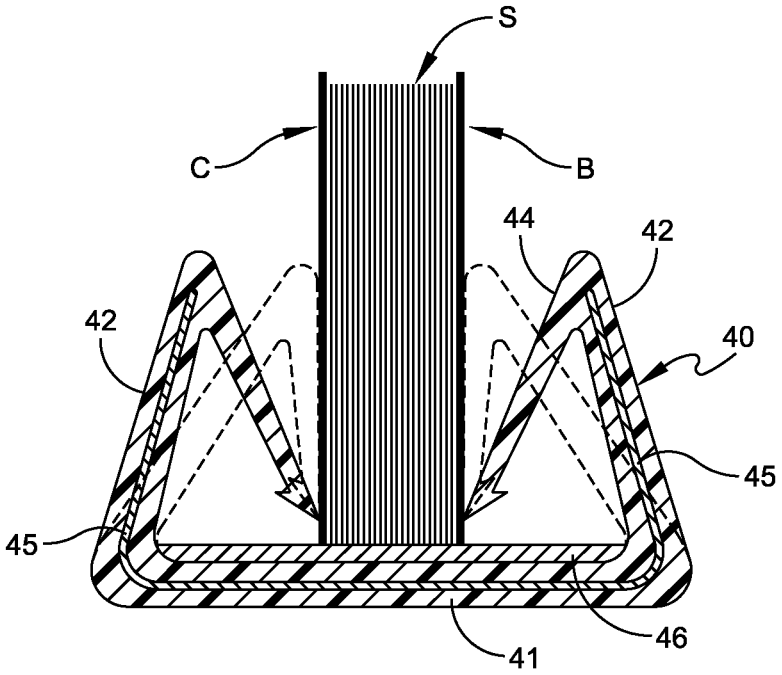
FIG. 4 is a cross-sectional view of a fourth embodiment of the present invention.

Reference is now made to a fourth embodiment of the present invention illustrated in FIG. 4. This embodiment also employs an extruded plastic element 40 with a coextruded crimpable metal liner 45. The basic plastic element 40 includes a base 41 and opposed legs 42. Each of the legs 42 terminates in a turned end 44. FIG. 4 illustrates the legs 42 in solid in an initial position and in dotted outline in a position wherein the legs have been inherently biased inwardly to be secured tightly against the covers C and B. The coextruded crimpable metal liner 45 preferably extends through the base 41 and up a substantial length of each of the legs 42 as depicted in FIG. 4. An unbiased position of the legs in FIG. 4 would also be one in which both legs 42 and 44 are closer together than shown in FIG. 4.

Figure 5:
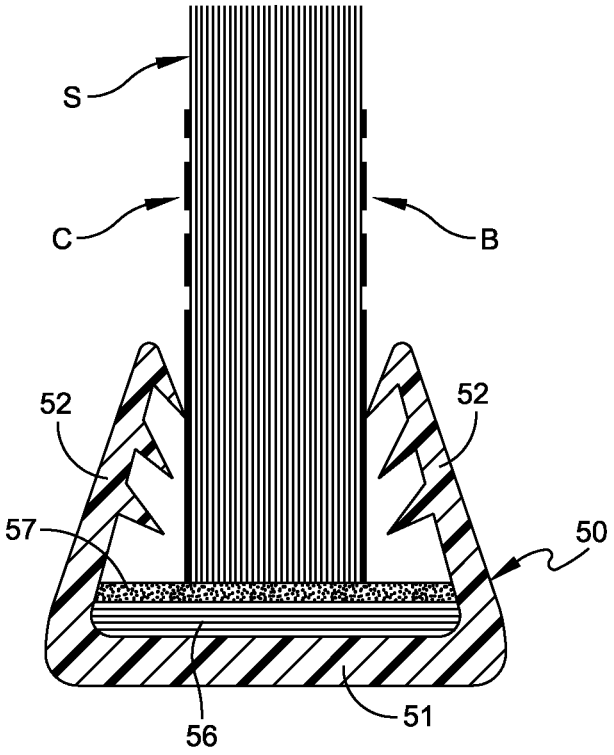
FIG. 5 is a cross-sectional view of a fifth embodiment of the present invention.

Reference is now made to a fifth embodiment of the present invention illustrated in FIG. 5. This embodiment is substantially the same as that previously described in FIG. 1 including an element 50 having a base 51 and opposed legs 52 with the illustrated ribs. In this embodiment, in addition to the thermal adhesive 56, there is also provided a contact adhesive 57. This arrangement enables a holding of the contents both initially for combining the contents into a unit and inserting and removing the unit from the thermal binding machine, and for permanently binding such unit. This embodiment also allows for a varied thickness of material to be bound as the legs can accommodate various thicknesses while at the same time imposing a biasing force against the covers B and C.

Figure 6:
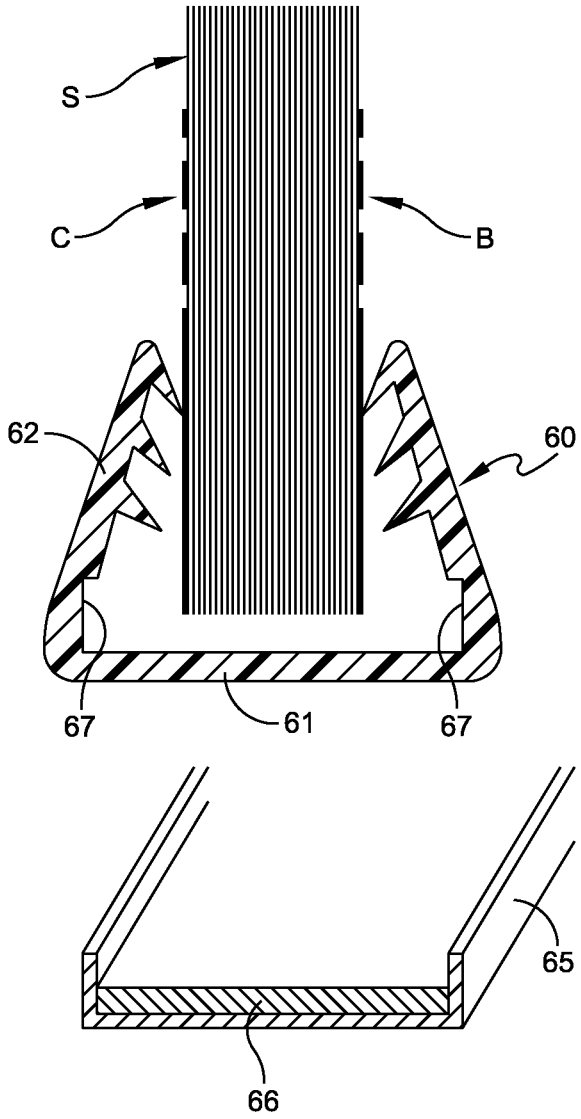
FIG. 6 is a cross-sectional view of a sixth embodiment of the present invention.

A sixth embodiment of the present invention is illustrated in FIG. 6. This includes an extruded plastic element 60, which like embodiments illustrated in FIGS. 1 and 5, includes a base 61 and opposed legs 62. In this particular embodiment the extruded plastic element has a profile that will accommodate a snap in or slide in element containing the thermal adhesive. This snap in member is illustrated in FIG. 6 by the channel or strip 65 that supports the thermal adhesive layer 66. Similarly, a simple thermal binding strip can be disposed in the channel 65 prior to binding. The opposed legs of the channel 65 are dimensioned for receipt within slots 67 in the extruded element 60. The channel 65, or like member, can be drawn (co-extruded with) with the extruded plastic to thus offer additional strength and/or malleability.

Figure 7:
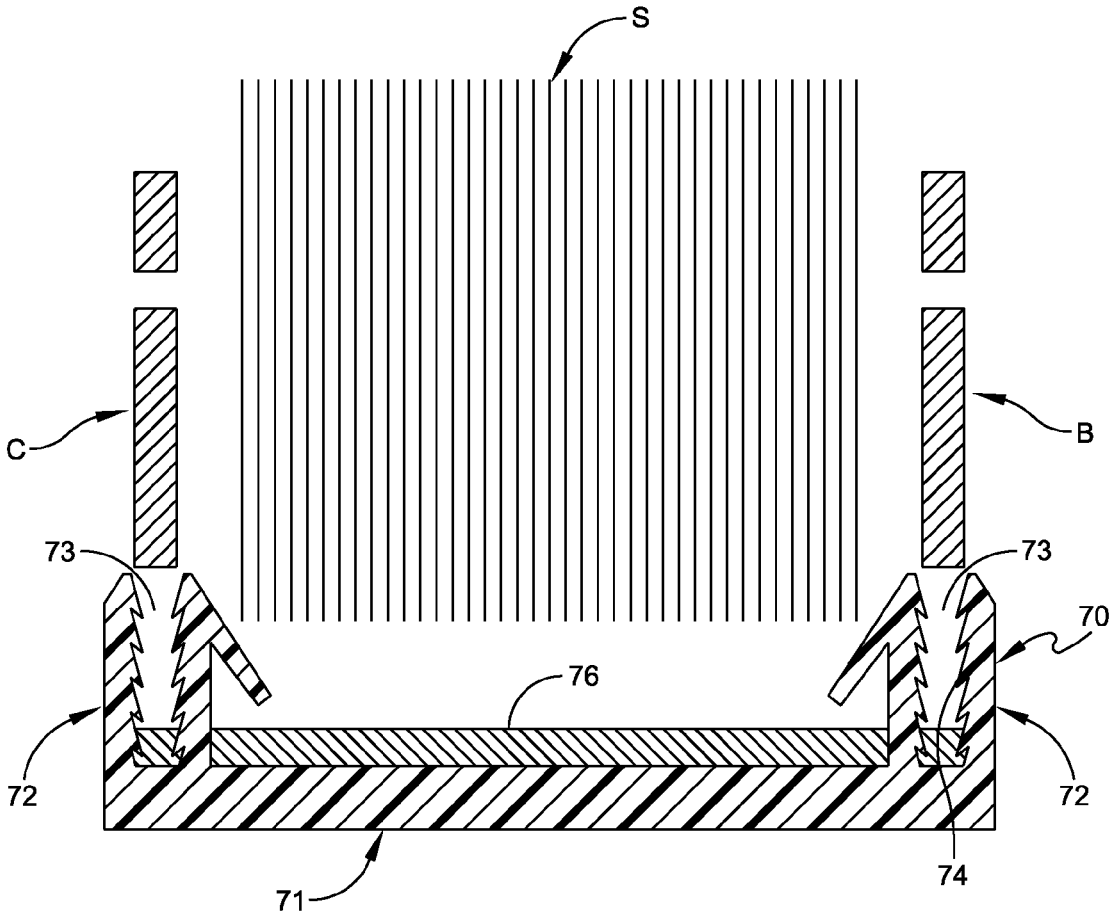
FIG. 7 is a cross-sectional view of a seventh embodiment of the present invention.

FIG. 7 is a cross-sectional view of a seventh embodiment of the present invention. This illustrates sheets S that are to be bound and also a chipboard cover C and a clipboard cover B. In FIG. 7 there is also illustrated the flexible extrusion 70 having a base 71 and opposed leg pairs 72. Each of these pairs 72 defines a channel 73. Inside of each of the channels on the respective legs of the pair are facing retention teeth 74. The extrusion 70 is flexible permitting the side channels to bend and the bottom spine 71 to curve when the covers are open. FIG. 7 also illustrates the hot melt adhesive material 76. This material may be coextruded with the basic extrusion or applied in an additional step.

In FIG. 7 the pair of leg members and base together defines a retention area in which the bundle of sheets is held. The pair of leg members is constructed and arranged with each formed by a set of inner and outer legs that are disposed substantially in parallel defining a channel 73 therebetween for receiving respective opposed covers B, C. The inner legs each have at least one inwardly directed rib 77 arranged for contact with respective sides of the bundle of sheets.

In accordance with other aspects of the present invention the pair of legs of a leg member 72 have inner facing surfaces that define the channel 73 with at least one of the inner facing surfaces having a set of engagement teeth 74 for holding a cover, wherein both facing surfaces of a set of legs have engagement teeth. A thermal adhesive layer is disposed on the base and upon which the bundle of sheets rests. The adhesive layer may be disposed between the leg members and also within each channel, as illustrated in FIG. 7.

The thermal adhesive can be applied during a co-extrusion process or subsequent to the extrusion. Such thermal adhesive may be multilayered or applied in a distributive fashion so as to provide both an intermediate adhesion and a long term thermally activated adhesion. The desired flexibility or firmness may be accomplished by simply varying the thickness of the thermal adhesive material or by combining two or more formulations during the coextrusion process.

Figure 8:
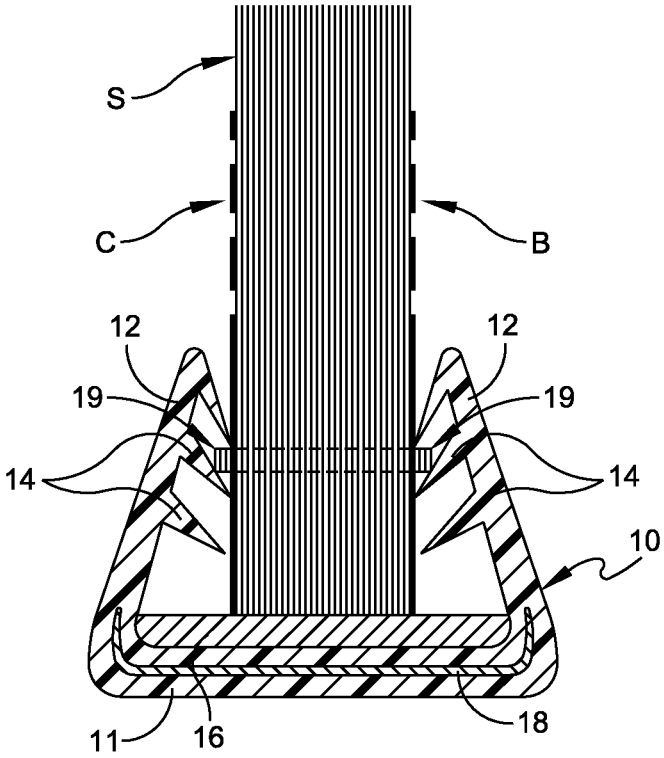
FIG. 8 is a view substantially the same as in FIG. 1 with the addition of one or more connecting staples.
Figure 9:
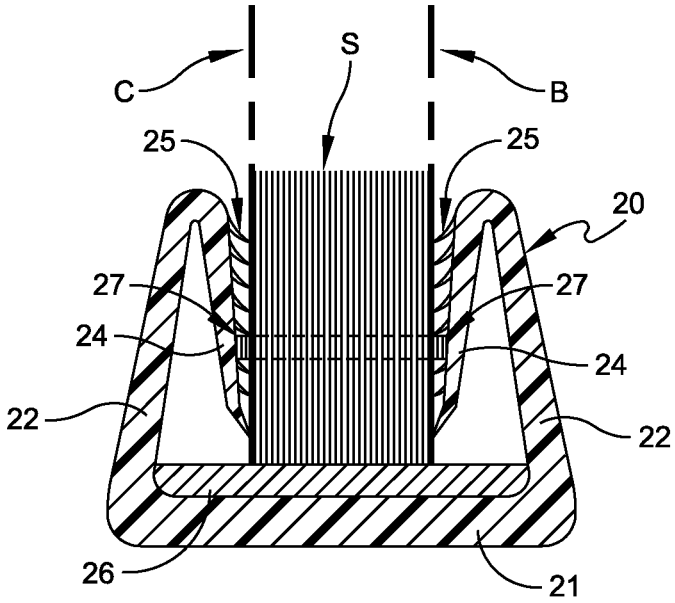
FIG. 9 is a view substantially the same as in FIG. 2 with the addition of one or more connecting staples.

Reference is now made to FIGS. 8 and 9. These figures are substantially the same as respective FIGS. 1 and 2 which are cross-sectional views. Accordingly, in FIGS. 8 and 9 the same reference numbers are used as previously identified in FIGS. 1 and 2. In the previously pending application, the types of materials that may be employed were not discussed in detail. The binding element may be constructed of metal, plastic and including such materials as nylon or composite materials. Also, previously the process was explained as constructing the elements by extrusion or co-extrusion. Alternatively, the process used may include stamping, injection molding and other types of processes to produce the binding element.

The sheets S identified in FIGS. 8 and 9, as well as in previous figures may be bound together with an adhesive or may be stapled. FIGS. 8 and 9 in particular show the use of staples. This includes a staple 19 in FIG. 8 and a staple 27 in FIG. 9. In FIG. 8 the longitudinal barbed ribs 14 catch against the staple 19 and in that way keep the contents from slipping out. Similarly, in the cross-sectional view of FIG. 9, the retention teeth 25 lock against the staple or staples 27 keeping the sheets in place.

The product of the present invention is considered as an improvement both to any form of slide binder and to the thermal binding spine or cover. To make the product suitable for use in thermal binding machines the binding profile should be extruded from a high temperate plastic, a composite or formed from spring steel. It is anticipated that a hot melt adhesive would be coextruded or added at the time the product is formed. Acetal plastics, and other engineered plastics can withstand temperatures up to 600 F while retaining their resilience. This makes it possible to have a slide on binder clip with hot melt adhesive that works in existing thermal binding equipment.

Although engineered plastics are more expensive and more difficult to extrude than PVC the advantage is that it accommodates a higher temperature adhesive which will hold its bond even when a report is left in the back window of a car on a sunny hot day. See the suggested engineered plastics set forth below.

Although a preferred form uses a high temperature plastic for the binding element, an alternative embodiment may use the same triangular profiles but made out of PVC using a coextruded adhesive that works at a lower temperature. This would require thermal binding machines that operate at a lower temperature at about 200 F. Alternatively, insulating adapters could be offered for existing machines to bring them down to that temperature. These would be designed to lower the surface temperature of the heating plates so that the PVC would not deform and or lose its gripping power. Such adapters can be in the form of insulating adaptors that can be placed over the heating plates of a thermal binding machine in order to reduce the surface temperature. For many of the thermal binding machines that are on the market, one can simply lay the adapter strip on top of the heating plate because the opening throat of the machine is wide enough to easily drop the strip and position it on the plate. For many other machines they have spring loaded clamps that hold the covers vertically in place. With those machines, one has to spread the clamps apart in order to get the strip in place. The adapter can include opposed Teflon layers with an insulating material disposed therebetween. The Teflon layer may comprise fiberglass coated with Teflon.

Engineering plastics are a group of plastic materials that exhibit superior mechanical and thermal properties in a wide range of conditions over and above more commonly used commodity plastics. The term usually refers to thermoplastic materials rather than thermosetting ones. Engineering plastics are used for parts rather than containers and packaging.

Examples of engineering plastics include:

1. Ultra-high-molecular-weight polyethylene (UHMWPE)
2. Nylon 6
3. Nylon 6-6
4. Polytetrafluoroethylene (PTFE/Teflon)
5. Acrylonitrile butadiene styrene (ABS)
6. Polycarbonates (PC)
7. Polyamides (PA)
8. Polybutylene terephthalate (PBT)
9. Polyethylene terephthalate (PET)
10. Polyphenylene oxide (PPO)
11. Polysulphone (PSU)
12. Polyetherketone (PEK)
13. Polyetheretherketone (PEEK)
14. Polyimides
15. Polyphenylene sulfide (PPS)
16. Polyoxymethylene plastic (POM/Acetal)
17. Polypropylene In accordance with another embodiment of the present invention there is provided a method of processing a binding element for retaining sheets, comprising the steps of: providing a binding element that includes a base, and a pair of opposed position legs that are integrally formed with and extend from respective sides of the base. The pair of legs and base together define a retention area in which the bundle of sheets is held, said pair of legs constructed and arranged with a resilient bias toward each other, but separable to enable the bundle of sheets to be held therebetween under a biasing force. The method includes providing a thermal adhesive layer disposed on the base and upon which the bundle of sheets rests, and constructing the binding element of an engineered plastic that can withstand temperatures in a range of at least 400 F to 600 F without deforming or weakening the binding element. Finally is the step of transferring the binding element to a thermal binding machine to subject the binding element to temperatures in a range of 250 F to 375 F in order to adhere the binding element and sheets. The method may also include providing the binding element and adhesive as a co-extrusion.

Having now described a limited number of embodiments of the present invention, it should now be apparent to those skilled in the art that numerous other embodiments and modifications thereof are contemplated as falling under the scope of the present invention, as defined by the appended claims.

What is claimed is:

1. A binding structure for binding a bundle of sheets and comprised of an element that includes a base, a pair of opposed position legs that are integrally formed with and extend from respective sides of the base, said pair of legs and base together defining a retention area in which the bundle of sheets is held, said pair of legs constructed and arranged with a resilient bias toward each other, but separable to enable the bundle of sheets to be held therebetween under a biasing force, said legs each having a series of spacedly disposed and inwardly directed ribs arranged for contact with opposed sides of the bundle of sheets, each leg having a substantially planar surface disposed at an acute angle to the base, from which the series of spacedly disposed ribs is supported and each rib is formed as a somewhat elongated flexible rib extending in a direction at an acute angle to the substantially planar surface and a thermal adhesive layer disposed on the base and upon which the bundle of sheets rests.

2. The binding structure of claim 1 wherein each of the spacedly disposed inwardly directed ribs has opposed surfaces that taper to a pointed free end.

3. The binding structure of claim 1 wherein each rib has a free end that is pointed.

4. The binding structure of claim 1 wherein each leg includes a turned end and the at least one rib extends from a respective turned end.

5. The binding structure of claim 4 wherein the base and legs together form a triangular retention area.

6. The binding structure of claim 5 wherein the spacedly disposed ribs each terminate in a free end and the free ends are disposed respectively at different spacings from the sides of the bundle of sheets.

7. The binding structure of claim 1 including a metal insert in the base.

8. The binding structure of claim 7 wherein the metal insert extends into each leg.

9. The binding structure of claim 1 including a thermal adhesive on the base and a contact adhesive disposed over the thermal adhesive.

10. The binding structure of claim 1 including a separate channel carrying a thermal adhesive and a slot at the base for receiving the channel.

11. The binding structure of claim 1 including a staple extending through the bundle of sheets.

12. The binding structure of claim 11 wherein the staple is engageable with at least one of the ribs.

13. The binding structure of claim 1 wherein the base includes an upwardly directed substantially planar surface defining in part the retention area, and the substantially planar inwardly directed surface of each leg is disposed at an acute angle to the upwardly directed substantially planar surface of the base.

14. The binding structure of claim 13 wherein the base and legs together form a triangular retention area.

15. The binding structure of claim 1 further including a metal insert that extends through said base having the metal insert imbedded in the base.

* * * * *